US005139693A

United States Patent [19]

Wilms et al.

[11] Patent Number: 5,139,693

[45] Date of Patent: Aug. 18, 1992

[54] GRANULAR ADSORBENT HAVING IMPROVED FLUSHING PROPERTIES

[75] Inventors: Elmar Wilms, Dormagen; Lothar Pioch, Duesseldorf; Guenther Vogt, Toenisvorst, all of Fed. Rep. of Germany

[73] Assignee: Henkel Kommanditgesellschaft auf Aktien, Duesseldorf/Holthausen, Fed. Rep. of Germany

[21] Appl. No.: 623,967

[22] PCT Filed: May 26, 1989

[86] PCT No.: PCT/EP89/00587

§ 371 Date: Dec. 3, 1990

§ 102(e) Date: Dec. 3, 1990

[87] PCT Pub. No.: WO89/12087

PCT Pub. Date: Dec. 14, 1989

[30] Foreign Application Priority Data

Jun. 3, 1988 [DE] Fed. Rep. of Germany ..... 3818829

[51] Int. Cl.[5] ..... C11D 9/00

[52] U.S. Cl. ..... 252/108; 252/174.25; 252/367; 252/368; 252/174.24; 252/133

[58] Field of Search ..... 252/109, 133, 135, 174.23, 252/DIG. 2, DIG. 11, 174.25, 108, 367, 368, 174.24, 174.13

[56] References Cited

U.S. PATENT DOCUMENTS

| | | | |
|---|---|---|---|
| 3,849,327 | 11/1974 | DiSalvo et al. | 252/109 |
| 3,886,098 | 5/1975 | DiSalvo et al. | 252/540 |
| 4,092,261 | 5/1978 | Sperling et al. | 252/131 |
| 4,136,051 | 1/1979 | Saran et al. | 252/91 |
| 4,243,544 | 1/1981 | Taylor | 252/135 |
| 4,605,509 | 8/1986 | Corkill et al. | 252/131 |
| 4,675,124 | 6/1987 | Seiter et al. | 252/91 |
| 4,707,290 | 11/1987 | Seiter et al. | 252/140 |
| 4,849,125 | 7/1989 | Seiter et al. | 252/109 |

*Primary Examiner*—Paul Lieberman
*Assistant Examiner*—Mary C. Dinunzio
*Attorney, Agent, or Firm*—Ernest G. Szoke; Wayne C. Jaeschke; Real J. Grandmaison

[57] ABSTRACT

A granular mixture produced by spray drying of (a) 45 to 75% by weight zeolite, (b) 1 to 6% by weight of a water soluble soap of substantially saturated $C_{12-18}$ fatty acids, (c) 1 to 12% by weight homopolymers or copolymers of acrylic acid, methacrylic acid or maleic acid or water-soluble salts thereof, expressed as sodium salt, (d) 0 to 25% by weight sodium sulfate, (e) 0 to 5% by weight surfactants of the nonionic polyglycol ether derivative type, (f) 10 to 22% by weight water, has an average particle size of 0.2 to 1.2 mm and an apparent density of 350 to 680 g/l. The product, which may be used as a detergent additive, has a high adsorption capacity for liquid to paste-form detergent constituents, more particularly nonionic surfactants, and improved flushing behavior when used in domestic washing machines.

13 Claims, No Drawings

GRANULAR ADSORBENT HAVING IMPROVED FLUSHING PROPERTIES

This invention relates to a granular adsorbent with a high adsorption capacity for liquid to pasty ingredients of detergents and cleaning preparations, more particularly liquid nonionic surfactants or nonionic surfactants that melt on heating, which is eminently suitable for use in phosphate-free or low-phosphate detergents and cleaning preparations. It shows considerably improved flushing properties, i.e. does not leave any undissolved residues in the dispensing compartments of automatic washing machines, and in addition improves the flushing properties of detergent mixtures in such dispensing compartments.

Nonionic surfactants are known to have very high detergent power which makes them particularly suitable for use in cold detergents or 60° C.-detergents. However, in the conventional production of detergents by spray drying, their percentage content cannot be increased significantly beyond 8 to 10% by weight because otherwise excessive pluming occurs in the exhaust air of the spray drying towers and the spray-dried powder is left with inadequate flow properties. Accordingly, processes have been developed in which the liquid or molten nonionic surfactant is applied to the previously spray-dried powder by mixing or is sprayed onto a carrier substance. Loose, more particularly spray-dried phosphates, borates or perborate, sodium alumosilicate (zeolite), silicon dioxide (Aerosil) or salt mixtures specifically prepared in advance, for example of sodium carbonate and sodium bicarbonate, have been proposed as carrier substances, but unfortunately all known adsorbents certain disadvantages. Phosphates are often undesirable on account of their eutrophicating properties. Borates of rather perborates have only a limited adsorption capacity for liquids. The same also applies to finely powdered zeolites, whereas special adsorbents, such as kieselguhr and Aerosil, as inert constituents make no contribution to the detergent effect.

Absorbent carrier granules which consist of several components and which are generally produced by spray drying are known, for example, from U.S. Pat. No. 3,849,327, U.S. Pat. No. 3,886,098 and U.S. Pat. No. 3,838,027 and from U.S. Pat. No. 4,269,722 (DE 27 42 683). However these carrier granules, which were developed in particular for the adsorption of nonionic surfactants, contain considerable quantities of phosphates which restricts their potential applications. Phosphate-free carrier granules are known from DE 32 06 265. They consist of 25 to 52% sodium carbonate or hydrogen carbonate, 10 to 50% zeolite, 0 to 18% sodium carbonate and 1 to 20% bentonite or 0.05 to 2% polyacrylate. However, the high percentage content of carbonate promotes the formation of calcium carbonate in hard water and, hence, the formation of incrustations on textile fibers and on the heating elements of washing machines. In addition, the adsorption capacity of the carrier granules mentioned above is limited. With percentage contents of more than 25% by weight liquid or tacky nonionic surfactants applied by mixing, the flow properties of the products deteriorate considerably and, above 30% by weight, are unsatisfactory.

EP 184 794 (U.S. Pat. No. 4,707,290) describes a granular adsorbent which is capable adsorbing large percentage contents of liquid to pasty detergent ingredients, more particularly nonionic surfactants, and (based on anhydrous substance) contains 60 to 80% by weight zeolite, 0.1 to 8% by weight sodium silicate, 3 to 15% by weight homo- or copolymers of acrylic acid, methacrylic acid and/or maleic acid, 8 to 18% by weight water and, optionally, up to 5% by weight nonionic surfactants and can be obtained by spray drying. In practice, it has been found that, in washing machines having poorly designed dispensing compartments, the products do not dissolve completely during the flushing phase and leave residues behind. This impaired flushing behavior not only is shown by the particles in question themselves, it can also affect the solubility or rather the flushing behavior of the other powder-form components of the detergent. The result of this is that a powder mixture having basically good flushing properties deteriorates in its overall flushing behavior when a powder component such as this is additionally present in the mixture.

Accordingly, the problem addressed by the present invention was to provide a granular adsorbent which would not have any of the disadvantages mentioned above, which would show a high adsorption capacity and which would exhibit improved flushing behavior. Accordingly, the present invention relates to a granular adsorbent having a high adsorption capacity for liquid to pasty components of detergents and cleaning preparations and improved flushing behavior, consisting essentially of (a) 45 to 75% by weight (expressed as anhydrous substance) of a cation-exchanging, finely crystalline, synthetic sodium alumosilicate containing bound water of the zeolite NaA type and mixtures thereof with zeolite NaX, (b) to 6% by weight soap derived from substantially saturated $C_{12-24}$ fatty acids in the form of the sodium and/or potassium soap, (c) 1 to 12% by weight of a homopolymeric or copolymeric acrylic acid, methacrylic acid and/or maleic acid and water-soluble salts thereof, expressed as sodium salt, (d) 0 to 25% by weight sodium sulfate, (e) 0 to 5% by weight of a nonionic surfactant containing polyglycol ether groups, (f) 10 to 24% by weight water, the adsorbent having an average particle size of 0.2 to 1.2 mm, the fraction with a particle size of less than 0.05 mm being less than 1% by weight, the fraction with a particle size of more than 2 mm being no more than 5% by weight and the apparent density being in the range from 350 to 680 g/l.

Component (a), which is present in quantities of 45 to 75% by weight, preferably 50 to 70% by weight and, more preferably, 55 to 68% by weight, consists of synthetic sodium alumosilicate containing bound water, preferably of the zeolite A type. Mixtures of zeolite NaA and NaX, in which the percentage content of the zeolite NaX is best below 30% and, more particularly, below 20%, may also be used. Suitable zeolites contain no particles larger than 30 μm in size, at least 80% of the zeolite consisting of particles smaller than 10 μm in size. Their average particle size (volume distribution, as measured by the Coulter Counter method) is in the range from 1 to 10 μm. Their calcium binding power, which is determined in accordance with DE 24 12 837, is in the range from 100 to 200 mg CaO/g. The zeolites may still contain excess alkali from their production.

Component (b) is a water-soluble soap, preferably a sodium soap, derived from $C_{12-24}$ and preferably $C_{14-22}$ fatty acids and mixtures thereof with oleic acid, in which case the percentage content of the saturated fatty acids should be at least 50% by weight and preferably at least 75% by weight. Examples are soaps of coconut oil, tallow and hydrogenated rapeseed oil fatty acids, hydrogenated fish oil fatty acids and mixtures thereof. Their percentage content is from 1.0 to 6% by weight, preferably from 1.5 to 5% by weight and more preferably from 2 to 4% by weight.

Component (c) is a homopolymeric and/or copolymeric carboxylic acid or a sodium or potassium salt thereof, the sodium salts being preferred. Suitable homopolymers are polyacrylic acid, polymethacrylic acid and polymaleic acid. Suitable copolymers are those of acrylic acid with methacrylic acid and copolymers of acrylic acid, methacrylic acid or maleic acid with vinyl ethers, such as vinyl methyl ether or vinyl ethyl ether; with vinyl esters, such as vinyl acetate or vinyl propionate, acrylamide, methacrylamide and with ethylene, propylene or styrene. In copolymeric acids such as, in which one of the components does not have an acid function, their percentage content is no more than 70 mol-% and preferably less than 50 mol-% in the interests of adequate solubility in water. Copolymers of acrylic acid and methacrylic acid with maleic acid, of the type described in detail, for example, in EP 25 551-B1, have proved to be particularly suitable. The copolymers in question contain 40 to 90% by weight acrylic acid or methacrylic acid and 60 to 10% by weight maleic acid. Copolymers in which 45 to 85% by weight acrylic acid and 55 to 15% by weight maleic acid are present are particularly preferred.

The molecular weight of the homopolymers or copolymers is generally in the range from 2,000 to 150,000 and preferably in the range from 5,000 to 10,000. Their percentage content in the adsorbent is from 1 to 12% by weight, preferably from 1.5 to 8% by weight and more preferably from 2 to 5% by weight, expressed as sodium salt. The resistance of the particles to abrasion increases with increasing percentage content of polyacid or salts thereof. An abrasion resistance sufficient for many purposes is obtained with a percentage content of only 1.5% by weight. Optimal abrasion properties are shown by mixtures containing 2 to 5% by weight sodium salt of the polyacid.

In one advantageous embodiment, the ratio by weight of soap (b) to polymer acid Na salt (c) is in the range from 2.5:1 to 1:5 and more particularly in the range from 1.5:1 to 1:4. These ranges are distinguished by good flushing results. Significant deviations, more particularly higher soap contents at the expense of the polymer acid component, result in less favorable values.

The sodium sulfate (component d), expressed as anhydrous substance, is present in quantities of 0 to 25% by weight, preferably in quantities of 0.5 to 22% by weight and more preferably in quantities of 3 to 20% by weight. In many cases, the sodium sulfate can lead to a significant improvement in the particle structure and flushing behavior of the adsorbent and, at the same time, increases its apparent density, so that it is possible to save packaging and transport volume.

The adsorbent may contain nonionic surfactants as an optional component (e) in quantities of up to 5% by weight, preferably quantities of 0 to 4% by weight and more preferably in quantities of 0.3 to 3% by weight. Suitable nonionic surfactants are, in particular, ethoxylation prodducts of linear or methyl-branched (oxo group) alcohols containing 12 to 18 carbon atoms and 3 to 10 ethylene glycol ether groups. Other suitable nonionic surfactants are ethoxylation products of vicinal diols, amines, thioalcohols and fatty acid amides which correspond to the described fatty alcohol ethoxylates in regard to the number of carbon atoms in the hydrophobic part and the glycol ether groups. Alkyl phenol polyglycol ethers containing 5 to 12 carbon atoms in the alkyl radical and 3 to 10 ethylene glycol ether groups may also be used. Finally, block polymers of ethylene oxide and propylene oxide commercially available under the name of Pluronics are also suitable nonionic surfactants. The nonionic surfactants may be present when the starting material used in the production of the granular adsorbent is an aqueous zeolite dispersion in which these surfactants function as dispersion stabilizers. In individual cases, the nonionic surfactants may even be completely or partly replaced by other dispersion stabilizers of the type described in DE 25 27 388 (U.S. Pat. No. 4,072,622).

The balance to 100% by weight consists of water which is present in bound form and as moisture, most of the water being bound to the zeolite. Approximately 8 to 18% by weight (based on the adsorbent) of the water can be removed at a drying temperature of 145° C. Another 4 to 8% by weight of the water, depending on the zeolite content, is released at the calcination temperature (800° C.) and corresponds sponds to the water incorporated in the crystal lattice of the zeolite.

The average particle size of the adsorbent is from 0.2 to 1.2 mm, the fraction of particles smaller than 0.05 mm in size being less than 1% by weight and preferably less than 0.5% by weight and the fraction larger than 2 mm in size being no more than 5% by weight. In a preferred embodiment, at least 80% by weight and, more particularly, at least 90% by weight of the particles are between 0.1 and 1.2 mm in size, the fraction of particles between 0.1 and 0.05 mm in size preferably being no more than 3% by weight and more particularly less than 1% by weight, the fraction of particles between 0.1 and 0.2 μm in size being less than 20% by weight and, more particularly, less than 10% by weight and the fraction of particles between 1.2 and 2 mm being no more than 10% by weight and, more particularly, no more than 5% by weight.

The adsorbent has an apparent density of from 350 to 680 g/l and preferably from 400 to 650 g/l. The adsorbent consists essentially of rounded particles which show very good flow properties. These very good flow properties are in evidence even when the particles are impregnated with large percentage contents of liquid or semiliquid detergent constituents, more particularly nonionic surfactants. The percentage content of these adsorbed constituents may be from 10 to 35% by weight and is preferably from 15 to 30% by weight, based on the adsorbate.

The present invention also relates to a process for the production of the granular adsorbent according to the invention. This process is characterized in that an aqueous slurry containing components (a) to (c) and, optionally, components (d), (e) and additional alkali metal hydroxide—with a total of 40 to 55% by weight anhydrous ingredients—is sprayed through nozzles into a tower and is dried to a moisture content removable at 145° C. of 8 to 18% by weight by means of drying gases which have an entry temperature of 150° to 280° C. and an exit temperature of 50° to 120° C.

The aqueous slurry may be prepared by mixing the dry or aqueous constituents with addition of the water required for liquefaction. The zeolite may be used in the form of a spray-dried powder or granules or even as a water-containing filter cake or in the form of an aqueous dispersion. Where spray-dried zeolite granules are used as the starting material, they may already contain polymers and/or the sodium sulfate or a proportion thereof. Instead of the soap or the salts of the polymeric carboxylic acids, the corresponding free acids may also be incorporated and the alkali required for salt formation may be separately added. In addition, it is recommended to add alkali metal hydroxide, more particularly NaOH, in order to alkalize the aqueous zeolite suspension or rather the slurry, i.e. to adjust it to a pH value of at least 8, and to provide for an adequate excess of alkali so that the pH value does not fall below 8 during spray drying. A reduction such as this in the pH value, which would result in a loss of activity of the zeolite, can be caused by $CO_2$ in the drying gas. The addition of NaOH, which establishes an adequate reserve of alkali, may amount for example to as much as 3% by weight, although an addition of 0.2 to 1% by weight is generally sufficient.

The percentage content of anhydrous ingredients in the aqueous slurry is preferably between 43 and 50% by weight. The temperature of the aqueous slurry is best in the range from 50° to 100° C. while its viscosity is between 2,000 and 20,000 mPa.s and generally between 8,000 and 14,000 mPa.s. The spray drying pressure is generally in the range from 20 to 120 bar and preferably in the range from 30 to 80 bar. The drying gas, which is generally obtained by burning heating gas or fuel oil, best flows in countercurrent to the slurry. Where so-called drying towers, into which the aqueous slurry is sprayed in the upper part through several high-pressure nozzles, are used, the entry temperature, as measured in the annular passage (i.e. immediately before entry into the lower part of the tower), is in the range from 150° to 280° C. and preferably in the range from 170° to 250° C. The moisture-laden waste gas leaving the tower typically has a temperature of 50° to 130° C. and preferably in the range from 55° to 115° C. The spray-drying process is conducted in such a way that the particle size of the spray-dried product has the distribution mentioned above. Any fine particles and coarse particles present are removed by sieving before further processing. It has been found that the flushing behavior of the adsorbent impregnated with nonionic surfactants deteriorates with increasing percentage content of fine particles.

If the adsorbent is to be impregnated with nonionic surfactants, the nonionic surfactants may be sprayed onto the spray-dried product both while it is still hot and after it has cooled or has been reheated after cooling. Heating of the nonionic surfactant to temperatures of 35° to 60° C. and preferably to temperatures of 40° to 50° C. accelerates the adsorption process. Providing the stated quantitative ratios and production conditions are observed, the abrasion resistance and dimensional stability of the particles are so high that even the freshly prepared particles, but especially the cooled and optionally reheated, ripened particles can be treated with the liquid additives, mixed and transported under the usual spray-mixing conditions without any formation of fines or relatively coarse agglomerates.

After the liquid additive has been applied, the particles may optionally be dusted or surface-coated with finely divided powders. Their flow properties can be further improved and their apparent density slightly increased in this way. Suitable dusting powders have a particle size of 0.001 to to at most 0.1 mm and preferably of less than 0.05 mm and may be applied in quantities of 0.03 to 3% by weight and preferably in quantities of 0.05 to 2% by weight, based on the adsorbent charged with additive. Suitable dusting powders are, for example, finely powdered zeolites, silica aerogel (Aerosil®), colorless or colored pigments, such as titanium dioxide, and other powder materials already proposed for the dusting of granules or rather detergent particles, such as finely powdered sodium tripolyphosphate, sodium sulfate, magnesium silicate and carboxymethyl cellulose. The products according to the invention generally do not have to be subjected to any such treatment, especially since their flushing properties are not improved as a result.

The additives to be adsorbed may consist of known nonionic surfactants of the type typically used in detergents and cleaning preparations. Other suitable additives are organic solvents with which the detergent power of detergents and cleaning preparations, more particularly with respect to greasy soil, is improved and which may readily be incorporated in a granular detergent in this way. Even sensitive substances, such as enzymes, biocides, fragrances, bleach activators, softeners, optical brighteners and also anionic or cationic surfactants, may be incorporated in the adsorbents after preliminary dissolution or dispersion in organic solvents or in the liquid or molten nonionic surfactants. These substances penetrate into the porous granules together with the solvent o dispersant and, in this way, are prevented from interacting with other powder constituents.

Preferred detergent components which are bound to the adsorbent and are present as a free-flowing mixture together with the adsorbent, are liquid to paste-form nonionic surfactants from the class of polyglycol ethers derived from alcohols containing 10 to 22 and more particularly 12 to 18 carbon atoms. These alcohols may be saturated or olefinically unsaturated, linear or methyl-branched in the 2-position (oxo group). Their reaction products with ethylene oxide (EO) and propylene oxide (PO) are watersoluble or water-dispersible mixtures of compounds having different degrees of alkoxylation. In technical alkoxylates, the number of EO or PO groups corresponds to the statistical mean value.

Examples of suitable ethoxylated fatty alcohols are $C_{12-18}$ coconut oil alcohols containing 3 to 12 EO, $C_{16-18}$ tallow alcohol containing 4 to 16 EO, oleyl alcohol containing 4 to 12 EO and ethoxylation products of corresponding chain and EO distribution obtainable from other native fatty alcohol mixtures. Suitable ethoxylated oxo alcohols are, for example, those having the composition $C_{12-15}$ +5 to 10 EO and $C_{14-15}$ +6 to 12 EO. Mixtures of alcohols having low and high degrees of ethoxylation are distinguished by increased detergency with respect both to greasy soil and to mineral soil; examples of such mixtures are, for example, mixtures of tallow alcohol+3 to 6 EO and tallow alcohol+12 to 16 EO or $C_{13-15}$ oxo alcohol+3 to 5 EO and $C_{12-14}$ oxo alcohol+8 to 12 EO. Detergents in which the adsorbed nonionic surfactants have both long hydrophobic residues and also relatively high degrees of ethoxylation exhibit particularly favorable flushing properties.

It has surprisingly been found that the solubility properties and the flushing behavior of the adsorbents impregnated with nonionic surfactants can be further increased if the nonionic surfactants additionally contain a compound which is poorly soluble or insoluble, but dispersible in water and contains polar, hydrophobic residues. Examples of such compounds are free, soap-forming fatty acids, partial esters of polyhydric alcohols, such as partial glycerides and fatty acid glycol esters, fatty acid amides, fatty acid partial amides of alkylenediamines and hydroxyalkyl alkylenediamines, fatty amines, quaternary ammonium bases and salts thereof, fatty alcohols and poorly soluble anionic surfactants, such as the disalts of α-sulfofatty acids. Mixtures of these poorly soluble or insoluble compounds may also be used. The number of carbon atoms in the hydrophobic residues should be at least 10 and is typically between 12 and 18. The quantitative ratios of the nonionic surfactant to the poorly soluble added compound are from 99:1 to 70:30. It is crucial to the success of the adsorbent that the nonionic surfactant and the additive are mixed with one another beforehand. The successive application of the individual constituents to the adsorbent does not lead to any improvement in solubility or flushing behavior.

Preferred examples of this group are coconut oil, tallow and rapeseed oil fatty acids, which may even be hydrogenated, mixtures of tallow fatty acid partial glyceride and the tallow fatty acid partial amide of hydroxyethyl ethylenediamine, ditallow alkyl dimethyl ammonium chloride and the disodium salt of α-sulfofatty acids derived from hydrogenated $C_{12-18}$ fatty acids.

The granular adsorbents impregnated with the nonionic surfactants or with the mixtures of nonionic surfactant and additive may be mixed in any ratio with other powder-form to granular detergents or detergent components, of the type obtainable by spray drying or granulation, or even with bleaches or with bleach-containing detergents of known composition. The favorable flow properties and high particle stability of the adsorbents are a considerable advantage in this regard because there is no unwanted formation of abrasion or dust. The powder mixtures for their part are stable in storage and show no tendency to cake or to exude the nonionic surfactant. In practical application, they show particularly good flushing behavior by comparison with known adsorbents.

EXAMPLE 1 to 4

In a stirred mixing vessel, the following constituents were mixed in the presence of water to form a slurry (pbw=parts by weight)

a) 67.3 pbw zeolite NaA (anhydrous) containing 0.4 pbw free NaOH
b) 4.0 pbw acrylic acid/maleic acid copolymer (Na salt)
c) 2.5 pbw Na soap ($C_{12-18}$ coconut oil/tallow soap 1:1)
d) 4.5 pbw sodium sulfate
e) 2.1 pbw ethoxylated tallow fatty alcohol containing 5 Eo The zeolite used had a calcium binding power of 165 mg CaO/g and an average particle size of 3 μm, containing no particles larger than 20 μm in size. It was used in the form of an aqueous dispersion containing 48% by weight anhydrous zeolite, 1.5% by weight component (e) and 53.1% by weight water. The polycarboxylic acid used was a copolymer of acrylic acid and maleic acid having a molecular weight of 70,000 (Sokalan ®) in the form of the sodium salt.

The slurry, which had a temperature of 85° C. and a viscosity of 10,200 mPa.s, was sprayed under a pressure of 40 atms. into a tower in which combustion gases at a temperature of 326° C. (as measured in the annular passage) flowed in countercurrent to the product to be spray-dried. The exit temperature of the drying gas was 60° C. The granular adsorbent leaving the spray-drying tower contained f) 19.2 pbw water.

The particle spectrum determined by sieve analysis produced the following weight distribution:

| mm | over 1.6 | up to 0.8 | up to 0.4 | up to 0.2 | up to 0.1 | under 0.1 |
|---|---|---|---|---|---|---|
| % by weight | 0 | 2 | 39 | 52 | 7 | 0 |

The weight per liter was 560 g/l.

The particles were sprayed with nonionic surfactants or surfactant mixtures heated to around 50° C. in a spraymixing apparatus consisting of a horizontally arranged cylindrical drum equipped with mixing and transporting elements and with spray nozzles (LODIGE mixer). The temperature of the adsorbent was 20° C. The surfactant melt consisted of (based on the final weight of the impregnated granules):

1) 18.0% by weight tallow alcohol +5 EO
2) 15.5% by weight 1 4 mixture of coconut oil alcohol +3 EO and tallow alcohol +5 EO
3) 15.2% by weight ethoxylate according to (2) and 0.3% by weight hydrogenated tallow fatty acid
4) 15.2% by weight ethoxylate according to (2) and 0.3% by weight of a 1:1 mixture of tallow fatty acid partial glyceride and tallow fatty acid amide of hydroxyethyl ethylenediamine.

The apparent densities of the products were increased by impregnation to values of 650 to 700 g/l. A granular, spray-dried zeolite NaA (Cl) and a soap-free carrier material produced in accordance with DE 34 44 960 (C2) were used for comparison and processed in the same way.

To determine its flow properties, 1 liter of the powder was poured into a funnel having the following dimensions which was closed at its outlet end:

| | |
|---|---|
| diameter of upper opening | 150 mm |
| diameter of lower opening | 10 mm |
| height of conical funnel section | 230 mm |
| height of lower cylindrical attachment | 20 mm |
| angle of inclination of conical section | 73° |

Dry sea sand having the following particle spectrum was used for comparison:

| mm | over 1.5 | up to 0.8 | up to 0.4 | up to 0.2 | up to 0.1 |
|---|---|---|---|---|---|
| % by weight | 0.2 | 11.9 | 54.7 | 30.1 | 3.1 |

The outflow time of the dry sand after the outlet opening had been released was equated with 100%. The flowability of the products according to the invention is expressed in %, based on this 100% value. Values above 75% count as very good.

In another series of tests, flushing behavior was tested under simulated conditions corresponding to a dispensing compartment of a domestic washing machine operated under critical conditions. Quantities of 100 g product were introduced into the test device (ZANUSSI dispensing channel) and, after standing for 1 minute, 10 liters tapwater were introduced over a period of 90 seconds. After 10 liters had been flushed in, the residues remaining were reweighed in the wet state and 30% of the weight was subtracted as water. Flushing behavior was evaluated on the basis of the following marking system:

A=complete flushing (the figure indicates the liters of water required),

B=residue less than 10 g (the figure indicates the residue in g),

C=more than 10 g residue (residue expressed in g).

A and B values are very good to satisfactory in practice. C values represent unsatisfactory flushing behavior.

The adsorbent was awarded a flushing mark of A 5. Another two series of tests were carried out using the impregnated adsorbent with no added detergent and a mixture of 25 parts of the impregnated adsorbent and 75 parts of a detergent consisting of 50 parts tower powder, 20 parts sodium perborate and 5 parts other granular constituents containing foam inhibitors, enzymes, fragrances and bleach activators (column heading "with D" in the following Table).

The tower powder had the following composition (in % by weight ):

| | |
|---|---|
| 17.6% | n-dodecylbenzene sulfonate (Na salt) |
| 2.5% | tallow soap (Na salt) |
| 4.0% | tallow alcohol + 14 EO |
| 20.5% | zeolite NaA (anhydrous) |
| 15.0% | soda |
| 5.0% | copolymer (b) |
| 0.5% | Na hydroxyethane diphosphonate |
| 3.0% | sodium silicate 1:3.3 |
| 1.6% | carboxymethyl cellulose |
| 18.0% | sodium sulfate |
| 12.3% | water |

The results are shown in the following Table:

| | | Flushing behavior | |
|---|---|---|---|
| Example | Flowability | without D | with D |
| 1 | 82 | B 2 | A 8 |
| 2 | 81 | B 1 | A 6 |
| 3 | 80 | A 5 | A 5 |
| 4 | 80 | A 6 | A 4 |
| C1 | 58 | C 48 | C 11 |
| C2 | 80 | C 48 | C 40 |

EXAMPLE 5

Granules having the following composition (in % by weight) were prepared in the same way as described in Example 1:

(a) 60.0% zeolite (anhydrous) containing 0.35% free NaOH (b) 5.2% acrylic acid/maleic acid copolymer (Na salt)

(c) 2.0% Na tallow soap (d) 13.2% sodium sulfate (e) 1.85% tallow fatty alcohol +5 EO (f) 17.4% water The weight per liter was 590 g/l. Sieve analysis produced the following particle size distribution:

| mm | over 1.6 | up to 0.8 | up to 0.4 | up to 0.2 | up to 0.1 | under 0.1 |
|---|---|---|---|---|---|---|
| % by weight | 0 | 3 | 41 | 50 | 6 | — |

As described in Example 1, 84 pbw of the adsorbent were impregnated with 16 pbw of a molten surfactant mixture corresponding to Example 2 in a spray-mixing apparatus. The product had an apparent density of 710 g/l and a flowability of 80% and was awarded a mark of A8 in the flushing test. A mixture of 20 pbw of these granules, 80 pbw of the spray-dried detergent used in Examples 1 to 4, 15 pbw sodium perborate and 5 pbw other granular constituents was awarded a mark of A6 in the flushing test carried out under the same conditions.

EXAMPLE 6

A granular adsorbent produced in accordance with Example 1 had the following composition (in % by weight):

(a) 60.0% zeolite alkalized with 0.8% NaOH (b) 3.0% tallow/coconut oil soap 1:1 (Na salt)

(c) 2.2% acrylic acid/maleic acid copolymer (Na salt)

(d) 15.2% Na sulfate (e) 1.8% tallow alcohol +5 EO (f) 17.0% water

After fine and coarse fractions had been removed by sieving, the product had an apparent density of 580 g/l for the following particle size distribution:

| mm | over 1.6 | up to 0.8 | up to 0.4 | up to 0.2 | up to 0.1 | under 0.1 |
|---|---|---|---|---|---|---|
| % by weight | 0 | 8 | 38 | 50 | 4 | 0 |

82% by weight of the granules were impregnated with 18% by weight of a $C_{13-15}$ oxo alcohol +5 EO. The treated product was awarded a mark of B5 in the flushing test. A mixture of 30 pbw of the product with 60 pbw spray-dried washing powder and 10 pbw perborate monohydrate was given a mark of B1.

EXAMPLE 7

An aqueous slurry was prepared using spray-dried zeolite granules. The granules consisted of a mixture of zeolite (with a water content removable at calcination temperature of 20% by weight) and anhydrous sodium sulfate. In addition, Na polyacrylate (MW 32,000), coconut oil/tallow soap and sodium hydroxide were incorporated in the slurry. The slurry had a water content of 52.5% by weight (including the water bound to the zeolite). The slurry, which had a temperature of 88° C., was spray-dried by the countercurrent process in a spray-drying tower, the drying gases having an entry temperature of 130° C. and an exit temperature of 67° C. The granules had the following composition (in % by weight):

59.0% zeolite (anhydrous)
0.6% NaOH
2.4% soap
2.5% Na polyacrylate
18.0% sodium sulfate
17.5% water, particle size 1.2 to 0.1 mm, average particle size 0.3 mm, apparent density 600 g/l. After impregnation with 16% by weight (based on impregnate) of a fatty alcohol ethoxylate mixture according to Example 2, a mark of B2 was awarded in the flushing test; after mixing with a washing powder corresponding to Example 6, a mark of A8 was awarded.

We claim:

1. A granular adsorbent having a high uptake capacity for liquid to pasty components of detergents and cleaning preparations and improved flushing behavior, consisting of (a) about 45 to about 75% by weight of a cationexchanging, finely crystalline, synthetic sodium aluminosilicate containing bound water of the zeolite NaA type and mixtures thereof with zeolite NaX, (b) about 1 to about 6% by weight of soap derived from substantially saturated $C_{12-24}$ fatty acids in the form of the sodium soap, the potassium soap, or mixtures thereof, (c) about 1 to about 12% by weight of a homopolymer selected from the group consisting of polyacrylic acid, polymethacrylic acid, and polymaleic acid; and a copolymer selected from eh group consisting of acrylic acid with methacrylic acid; acrylic acid, methacrylic acid or maleic acid with a vinyl ether, a vinyl ester, acrylamide, methacrylamide, ethylene, propylene or styrene; and acrylic acid or methacrylic acid with maleic acid, and water-soluble sodium salts thereof, (d) 0 to about 25% by weight sodium sulfate, (e) 0 to about 5% by weight of a nonionic surfactant containing polyglycol ether groups, and (f) about 10 to about 24% by weight water, said adsorbent having an average particle size of about 0.2 to about 1.2 mm, the fraction having a particle size of less than 0.05 mm being less than about 1% by weight, the fraction having a particle size of more than 2 mm being no more than about 5% by weight and the apparent density of said adsorbent being in the range from about 350 to about 680 g/l.

2. An adsorbent as in claim 1 containing about 50 to about 70% by weight of component (a).

3. An adsorbent as in claim 1 containing about 1.5 to about 5% by weight of component (b).

4. An adsorbent as in claim 1 containing about 1.5 to about 8% by weight of component (c).

5. An adsorbent as in claim 1 containing about 0.5 to about 22% by weight of component (d).

6. An adsorbent as in claim 1 containing 0 to about 4% by weight of component (e).

7. An adsorbent as in claim 1 in which at least about 80% by weight of the particles are between about 0.1 and about 1.2 mm in size, the fraction of particles between about 0.1 and about 0.05 mm in size being no more than about 3% by weight and, the fraction of particles larger than about 1.2 to about 2 mm in size being no more than about 10% by weight.

8. An adsorbent as in claim 1 in which component (b) consists of the sodium soap of $C_{14-22}$ fatty acids of which at least about 75% by weight are saturated.

9. An adsorbent as in claim 1 impregnated with about 10 to about 35% by weight, based on the final treated product, of at least one nonionic surfactant.

10. A product as in claim 9 wherein said nonionic surfactant is mixed with a compound containing hydrophobic radicals wherein the number of carbon atoms in said hydrophobic radicals is from 12 to 18, and wherein said compound is insoluble or only poorly soluble in water, but is dispersible in water.

11. A process for the production of a granular adsorbent as in claim 1 comprising spraying an aqueous slurry of components (a) to (c) and, optionally, (d) and (e), which contains about 40 to about 55% by weight anhydrous ingredients, into a drying tower and drying said slurry to a moisture content removable at about 145° C. of about 8 to about 18% by weight by means of drying gases which have an entry temperature of about 150° to about 280° C. and an exit temperature of about 50° to about 120° C.

12. A process as in claim 11, including mixing the spraydried adsorbent with a liquid or molten nonionic surfactant or surfactant mixture.

13. A powder-form to granular, phosphate-free to low-phosphate detergent containing the adsorbent of claim 1.

* * * * *